US008042285B2

(12) United States Patent
Romano et al.

(10) Patent No.: US 8,042,285 B2
(45) Date of Patent: Oct. 25, 2011

(54) LAUNDRY DRYER WITH A HOLDING DEVICE

(75) Inventors: Salvatore Romano, Wardenburg (DE); Marco Ruechel, Herzebrock-Clarholz (DE); Kerstin Schroeder, Versmold (DE); Thomas Vartmann, Beelen (DE)

(73) Assignee: Miele & Cie. KG, Guetersloh (DE)

( * ) Notice: Subject to any disclaimer, the term of this patent is extended or adjusted under 35 U.S.C. 154(b) by 679 days.

(21) Appl. No.: 12/195,632

(22) Filed: Aug. 21, 2008

(65) Prior Publication Data

US 2009/0049707 A1 Feb. 26, 2009

(30) Foreign Application Priority Data

Aug. 22, 2007 (DE) ..... 10 2007 039 707

(51) Int. Cl.
*F26B 19/00* (2006.01)

(52) U.S. Cl. ..... 34/603; 705/14; 292/302; 292/340; 34/610; 34/242; 34/86; 248/674; 8/159; 68/20; 68/25; 192/136

(58) Field of Classification Search ..... 34/601, 34/603, 606, 610, 210, 242, 90, 86; 68/20, 68/25; 8/159; 192/136; 705/14; 248/674; 292/302, 340

See application file for complete search history.

(56) References Cited

U.S. PATENT DOCUMENTS 1,509,830 A * 9/1924 Fischedick et al. ..... 74/81
1,588,622 A * 6/1926 Savoy ..... 68/142
1,975,982 A * 10/1934 Snyder ..... 68/25
2,114,776 A * 4/1938 Davis ..... 68/18 R
2,165,884 A * 7/1939 Chamberlin et al. ..... 8/159
2,307,254 A * 1/1943 Bassett, Jr ..... 68/20
2,311,924 A * 2/1943 Bassett, Jr ..... 210/141
RE22,375 E * 9/1943 Chamberlin et al. ..... 8/159
2,372,790 A * 4/1945 Morgenstern ..... 34/609
2,539,407 A * 1/1951 Dinley ..... 34/74
2,633,646 A * 4/1953 Smith ..... 34/425
2,643,463 A * 6/1953 Grantham ..... 34/546
2,655,241 A * 10/1953 Johannes ..... 192/136
2,743,530 A * 5/1956 Smith et al. ..... 34/547
2,807,889 A * 10/1957 Dunkelman ..... 34/546
2,814,886 A * 12/1957 Fowler ..... 34/605
2,859,025 A * 11/1958 Strobel ..... 432/44
2,974,421 A * 3/1961 Strobel ..... 34/527

(Continued)

FOREIGN PATENT DOCUMENTS

DE 4132863 A1 * 4/1993

(Continued)

*Primary Examiner* — Stephen M. Gravini
(74) *Attorney, Agent, or Firm* — Leydig, Voit & Mayer, Ltd.

(57) ABSTRACT

A laundry dryer comprising a housing and a rotatably mounted laundry drum. A carbon contact holder assembly including a supporting part and includes a receptacle having a longitudinal axis disposed at an angle α with respect to a perpendicular cross sectional plane of the laundry drum. The supporting part includes an integrally supporting arm extending in a direction of the longitudinal axis of the receptacle. The supporting arm includes an attachment section configured to attach to the housing and a clamp strap configured to hold cables. A carbon contact is disposed in the receptacle and movable against a spring force along the longitudinal axis in a radial direction of the laundry drum. The dryer includes a latching receptacle disposed on the supporting part that includes a plug-in contact connected to the carbon contact by a flexible lead.

17 Claims, 3 Drawing Sheets

U.S. PATENT DOCUMENTS 3,060,591 A * 10/1962 Liebermann ..... 34/572
3,084,531 A * 4/1963 Matheny ..... 68/210
3,142,641 A * 7/1964 Lachat ..... 210/144
3,231,909 A * 2/1966 Candor ..... 8/159
3,235,082 A * 2/1966 Wilfried ..... 34/319
3,246,493 A * 4/1966 Oles ..... 68/18 R
3,250,097 A * 5/1966 Czech ..... 68/12.09
3,270,531 A * 9/1966 Czech ..... 68/18 F
3,274,807 A * 9/1966 Czech ..... 68/12.09
3,281,953 A * 11/1966 Mueller et al. ..... 34/528
3,283,548 A * 11/1966 Czech ..... 68/12.08
3,318,122 A * 5/1967 Starr et al. ..... 68/210
3,358,302 A * 12/1967 Candor ..... 8/159
3,388,567 A * 6/1968 Oles ..... 68/18 R
3,402,477 A * 9/1968 Hubbard ..... 34/543
3,402,576 A * 9/1968 Krupsky ..... 68/4
3,676,199 A * 7/1972 Hewitt et al. ..... 428/213
3,691,645 A * 9/1972 Nethersell ..... 34/58
3,696,903 A * 10/1972 Nethersell ..... 192/136
3,823,329 A * 7/1974 Crook et al. ..... 307/141
3,972,131 A * 8/1976 Rudy et al. ..... 34/60
3,991,479 A * 11/1976 Dionne ..... 34/248
4,027,218 A * 5/1977 Polkinghorne et al. ..... 388/809
4,132,009 A * 1/1979 Bochan ..... 34/534
4,179,907 A * 12/1979 Schantz ..... 68/12.26
4,262,945 A * 4/1981 Paulson ..... 292/89
4,275,508 A * 6/1981 Jones ..... 34/524
4,286,811 A * 9/1981 Schantz ..... 292/201
4,342,476 A * 8/1982 Brown et al. ..... 292/201
4,426,794 A * 1/1984 Vanderheijden ..... 34/109
4,665,628 A * 5/1987 Clawson ..... 34/449
4,669,199 A * 6/1987 Clawson et al. ..... 34/82
4,868,998 A * 9/1989 Rubin ..... 34/91
5,194,185 A * 3/1993 Cannon et al. ..... 261/7
5,213,594 A * 5/1993 Cannon et al. ..... 95/90
5,940,988 A * 8/1999 Eisen ..... 34/596
6,219,885 B1 * 4/2001 Faas et al. ..... 19/98
6,954,992 B2 * 10/2005 Hwang ..... 34/108
7,073,356 B2 * 7/2006 Nakamura et al. ..... 68/12.26
7,159,910 B2 * 1/2007 Hwang ..... 292/341.15
7,320,185 B2 * 1/2008 Heyder et al. ..... 34/602
7,322,127 B2 * 1/2008 Hwang ..... 34/603
7,490,495 B2 * 2/2009 Kim ..... 68/196
7,490,496 B2 * 2/2009 Kim et al. ..... 68/196
7,614,263 B2 * 11/2009 Kim et al. ..... 68/196
7,637,128 B2 * 12/2009 Kim ..... 68/23.1
7,827,830 B2 * 11/2010 Kim ..... 68/13 R
7,882,716 B2 * 2/2011 Noro et al. ..... 68/18 C
7,950,254 B2 * 5/2011 Gray et al. ..... 68/3 SS
2003/0061841 A1 * 4/2003 Nakamura et al. ..... 68/12.26
2003/0151328 A1 8/2003 Cutsforth et al.
2003/0221293 A1 * 12/2003 Gujer ..... 19/114
2004/0083769 A1 * 5/2004 Kim et al. ..... 68/12.02
2004/0084602 A1 * 5/2004 Heyder et al. ..... 248/674
2004/0104582 A1 * 6/2004 Hwang ..... 292/121
2004/0107598 A1 * 6/2004 Hwang ..... 34/601
2004/0111916 A1 * 6/2004 Hwang ..... 34/601
2004/0117920 A1 * 6/2004 Fyvie et al. ..... 8/158
2005/0172678 A1 * 8/2005 Kim et al. ..... 68/3 R
2005/0252255 A1 * 11/2005 Gray et al. ..... 68/145
2005/0252532 A1 * 11/2005 Gray et al. ..... 134/25.2
2005/0252538 A1 * 11/2005 Vernon et al. ..... 134/94.1
2006/0005581 A1 * 1/2006 Banba ..... 68/5 R
2006/0086151 A1 * 4/2006 Kim et al. ..... 68/196
2006/0086152 A1 * 4/2006 Kim et al. ..... 68/196
2006/0086154 A1 * 4/2006 Kim ..... 68/196
2006/0086155 A1 * 4/2006 Kim et al. ..... 68/196
2008/0019065 A1 * 1/2008 Heyder et al. ..... 361/56
2008/0196268 A1 * 8/2008 Jung et al. ..... 34/603
2008/0235984 A1 * 10/2008 Yoon ..... 34/601
2008/0282747 A1 * 11/2008 Kim ..... 68/13 R
2009/0049707 A1 * 2/2009 Romano et al. ..... 34/108
2009/0049872 A1 * 2/2009 Noro et al. ..... 68/18
2009/0064724 A1 * 3/2009 Kim ..... 68/23.1
2009/0066205 A1 * 3/2009 Park et al. ..... 312/228
2009/0159301 A1 * 6/2009 Chatot et al. ..... 169/56
2009/0211108 A1 * 8/2009 Moschutz et al. ..... 34/491
2009/0308111 A1 * 12/2009 Robb et al. ..... 68/17 R
2010/0077803 A1 * 4/2010 Lim et al. ..... 68/212
2010/0083712 A1 * 4/2010 Lim et al. ..... 68/139
2010/0088917 A1 * 4/2010 Lim ..... 34/88
2010/0115785 A1 * 5/2010 Ben-Shmuel et al. ..... 34/260
2010/0139366 A1 * 6/2010 Krausch ..... 73/23.34
2010/0275659 A1 * 11/2010 Son et al. ..... 68/17 R
2010/0319213 A1 * 12/2010 Kim et al. ..... 34/565
2011/0083478 A1 * 4/2011 Silva ..... 68/200
2011/0119952 A1 * 5/2011 Nawrot et al. ..... 34/427

FOREIGN PATENT DOCUMENTS

DE 4238546 A1 * 5/1994
DE 4437635 4/1996
DE 19523896 A1 1/1997
DE 102006005786 8/2007
EP 0547437 A2 6/1993
EP 552843 A1 * 7/1993
EP 1391549 A1 * 2/2004
EP 1626479 2/2006
EP 1770201 4/2007
EP 2177658 A1 * 4/2010
FR 2621335 A1 * 4/1989
GB 2302999 A 2/1997
JP 03018398 A * 1/1991
JP 03080898 A * 4/1991
JP 04152995 A * 5/1992
JP 05131080 A * 5/1993
JP 2006346498 A * 12/2006
JP 2007301178 A * 11/2007
WO WO 2010079959 A2 * 7/2010

* cited by examiner

LAUNDRY DRYER WITH A HOLDING DEVICE

CROSS REFERENCE TO RELATED APPLICATIONS

Priority is claimed to German patent application DE 10 2007 039 707.2, filed Aug. 22, 2007, which is hereby incorporated by reference herein.

FIELD

The invention relates to a laundry dryer having a carbon contact holder assembly arranged on a supporting part, in which a carbon contact is arranged on the lengthwise axis of its receptacle in the radial direction of the rotatably mounted laundry drum in such a way that it can be moved against a spring force, and in which a latching receptacle with a plug-in contact that is connected to the carbon contact via a flexible lead is arranged on the supporting part.

BACKGROUND

A laundry dryer with a carbon contact is described in EP 1 770 201 A1. In order to accommodate a laundry drum with the largest possible radius in the housing of a laundry dryer, no components are placed above or below the vertical axis of the laundry drum that would hinder a maximum utilization of the volume. In this design, the carbon contact holder assembly is mounted obliquely with respect to a reference plane of the laundry drum extending vertically or horizontally, which makes it possible to accommodate the carbon contact holder assembly in a free space of the laundry dryer volume. The drawing shows an arrangement of the carbon contact holder assembly in the lower side area of the laundry drum. A carbon contact holder assembly that is suitable for such an arrangement is described in European Patent Application EP 1 626 479 B1, which is hereby incorporated by reference herein.

German patent specification DE 44 37 635 C2 shows a support for the carbon contact holder assembly that is attached to a supporting structure of the housing by means of screwed connections. The carbon contact holder assembly is configured to receive two carbon contacts that are insulated with respect to each other and that are positioned in the upper side area of the laundry drum. This has the advantage that, if maintenance is needed, the carbon contacts are arranged so as to be easily accessible in the housing. A screwed connection is provided in order to securely attach the carbon contact holder assembly to the supporting structure of the housing. However, this embodiment has the drawback that, when the support is mounted, the tightening of the screws can cause the carbon contacts to shift with respect to the sliding contact strips on the circumference of the drum. This results in residual moisture measurements that are incorrect or altogether absent. Another drawback of this configuration relates to the layout of the flexible leads to the carbon contacts, which increases the assembly effort needed for the carbon contact holder assembly.

German patent application DE 10 2006 005 786 A1 describes a laundry dryer in which the receptacle for the carbon contacts or the supporting part for them is mounted on the attachment section by means of a swiveling and spring-loaded lever. Due to the many moving parts, this construction is complicated, and a precise positioning has to be ensured during the assembly. Furthermore, it can happen that, over the course of time, the contact carbons diverge from their prescribed course if the lever hinges are worn out.

SUMMARY

An aspect of the present invention is to provide a supporting part for a carbon contact holder assembly in such a way that a precise positioning on the supporting structure of the housing is possible and so that the assembly effort is decreased.

In an embodiment, the present invention provides a laundry dryer comprising a housing and a rotatably mounted laundry drum. A carbon contact holder assembly including a supporting part and includes a receptacle having a longitudinal axis disposed at an angle $\alpha$ with respect to a perpendicular cross sectional plane of the laundry drum. The supporting part includes an integrally formed supporting arm extending in a direction of the longitudinal axis of the receptacle. The supporting arm includes an attachment section configured to attach to the housing and a clamp strap configured to hold cables. A carbon contact is disposed in the receptacle and movable against a spring force along the longitudinal axis in a radial direction of the laundry drum. The dryer includes a latching receptacle disposed on the supporting part that includes a plug-in contact connected to the carbon contact by a flexible lead.

BRIEF DESCRIPTION OF THE DRAWINGS

An embodiment of the invention is described below in greater detail and shown schematically in the drawings, in which.

DETAILED DESCRIPTION

Having the supporting part be affixed to or positioned on the supporting structure of the housing by means of the attachment section of the supporting part is advantageous. The supporting part is configured as a supporting arm that is formed in one piece onto a receptacle for the carbon contact. The assembly effort for the entire holding device and for the cable layout is reduced by an integrally formed cable holder as well as by the attachment section that is connected to the supporting arm.

Figure 1:
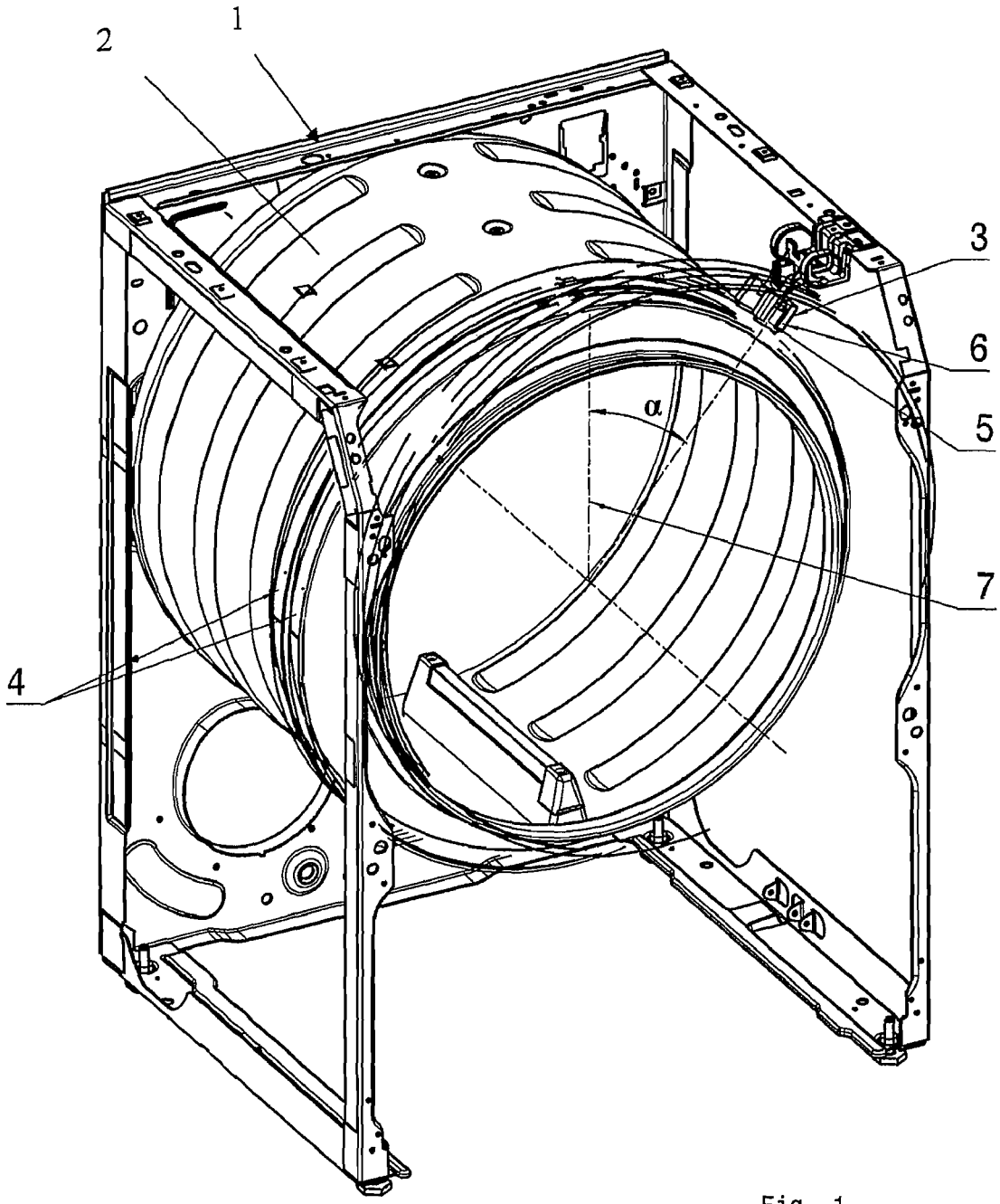
FIG. 1 shows a laundry dryer with a carbon contact holder assembly arranged on a supporting part.

FIG. 1 shows the supporting structure 1 for the housing of a laundry dryer with the carbon contact holder assembly 3 arranged near the upper area of the laundry drum 2. The laundry drum 2 is rotatably mounted and, on its drum circumference, has two contact strips 4 of a device for detecting the residual moisture content in the laundry. The carbon contacts 5 of the carbon contact holder assembly 3 are associated with the contact strips 4. Similar to a manner described in EP 1 626 479 B1, the carbon contacts 5 are affixed in a receptacle 6 of the carbon contact holder assembly 3 and pressed against the contact surfaces of the contact strips 4. The receptacle 6 has a shaft-like configuration. The carbon contacts 5 are arranged so that they can be moved against a spring force on the longitudinal axis 7 of the receptacle 6 in the radial direction of the rotatably mounted laundry drum 2. The longitudinal axis 7 of the receptacle 6 is arranged at an angle α within an angular range from 40° to 80° with respect to the center line of the laundry drum 2.

Figure 2:
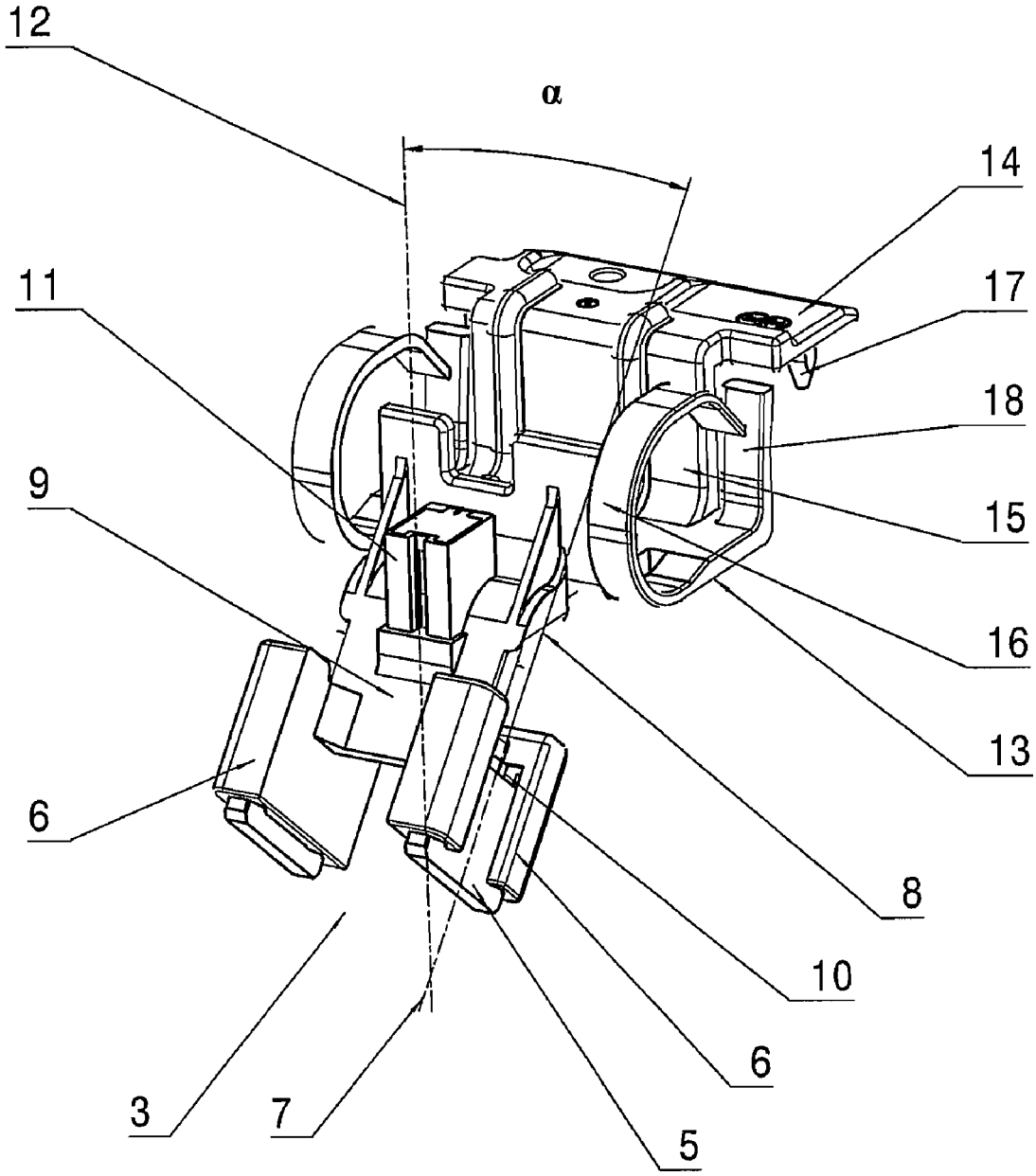
FIG. 2 is a perspective view of the supporting part with the carbon contact holder assembly.

FIG. 2 is a perspective view of the carbon contact holder assembly 3 arranged on a supporting part 8. The supporting part 8 is configured as a supporting arm 9 that is integrally formed extending in the direction of the longitudinal axis 7 of the receptacles 6. The carbon contact holder assembly 3 comprises two receptacles 6 for carbon contacts 5, said receptacles being arranged in parallel with respect to each other. Each of the receptacles 6 has two spring elements 10 that press the carbon contact 5 against the contact surface of the contact strip 4.

The receptacles 6 are connected to each other in one piece via the supporting arm 9 so that a supporting surface is formed for an integrally-formed latching receptacle 11 with plug-in contacts. The connection elements of the plug-in contacts to the flexible leads of the carbon contacts 5 are arranged underneath the supporting surface or the supporting arm 9. The flexible leads of the carbon contacts 5 are laid in a conventional manner with respect to the plug-in contacts of the latching receptacle 11. The plugging axis 12 of the plug-in contacts in the latching receptacle 11 preferably runs at the same angle α with respect to the longitudinal axis 7 of the receptacles 6.

The supporting arm 9 is affixed via an attachment section 13 to the supporting structure 1 for the housing of the laundry dryer. The attachment section 13 is integrally formed on the supporting arm 9 and is configured as an attachment bracket with a supporting leg 14 that rests on the supporting structure 1 of the housing and with a laterally positioned support bracket 15. The support bracket 15 has a holder for cables that is configured as a clamp strap 16.

Figure 3:
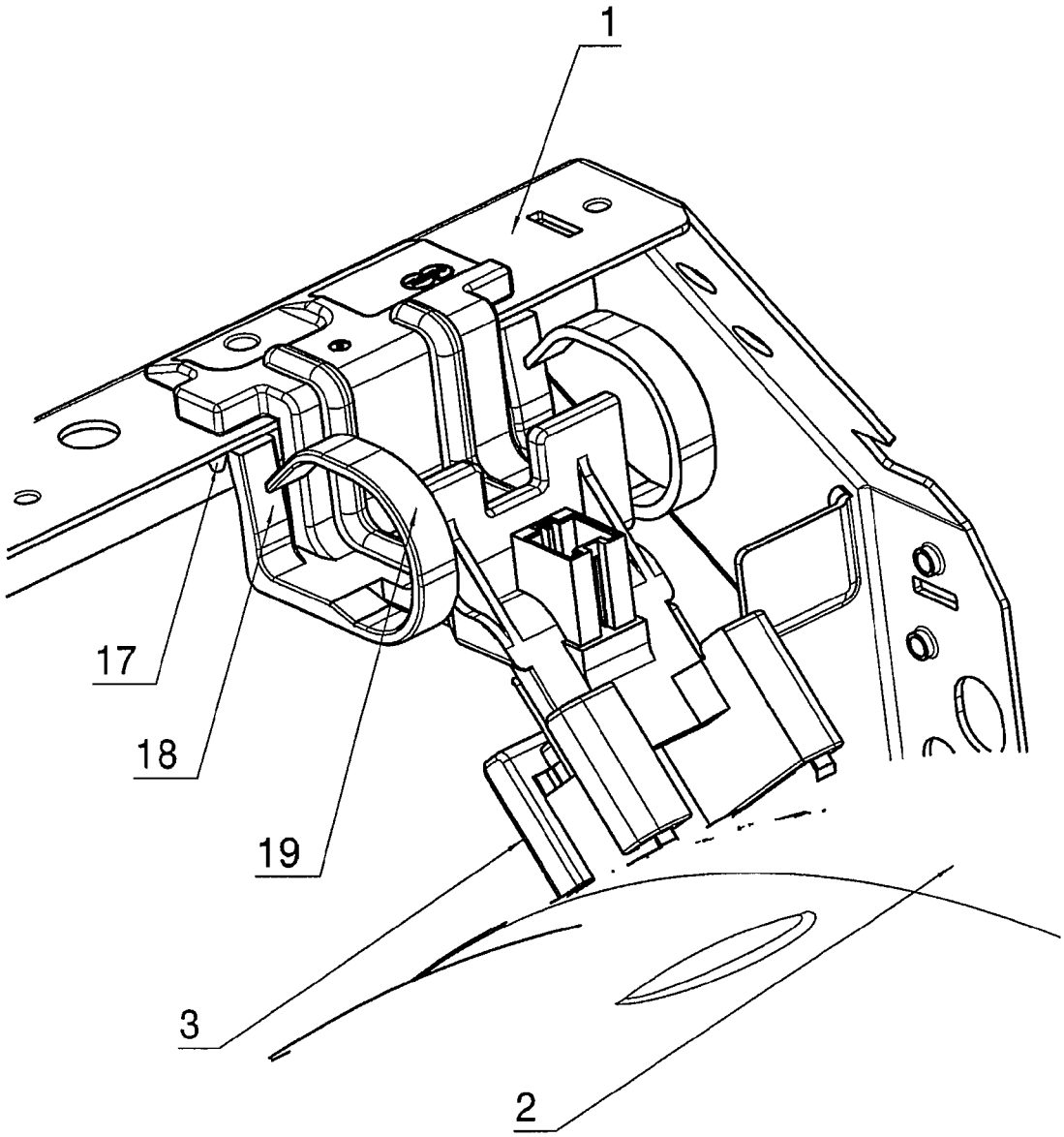
FIG. 3 shows the attachment section of the supporting part in its position on the supporting structure of the housing.

On the supporting leg 14, at least one integrally formed pin 17 is provided that engages into a bore on the supporting structure 1 of the housing and that positions the carbon contact holder assembly 3 in its position relative to the laundry drum 2. At least one resilient tab 18 (hook) is formed onto the laterally positioned support bracket section and this tab 18 engages behind the supporting structure 1 of the housing and affixes the carbon contact holder assembly 3 onto the housing in its position relative to the laundry drum 2 (also see FIG. 3).

What is claimed is:

1. A laundry dryer comprising:

a housing;

a rotatably mounted laundry drum;

a carbon contact holder assembly including a supporting part, the carbon contact holder assembly including a receptacle having a longitudinal axis disposed at an angle α with respect to a perpendicular cross sectional plane of the laundry drum, the supporting part including an integrally formed supporting arm extending in a direction of the longitudinal axis of the receptacle, the supporting arm including an attachment section configured to attach to the housing and a clamp strap configured to hold cables;

a carbon contact disposed in the receptacle and movable against a spring force along the longitudinal axis in a radial direction of the laundry drum; and a latching receptacle disposed on the supporting part, the latching receptacle including a plug-in contact connected to the carbon contact by a flexible lead.

2. The laundry dryer as recited in claim 1 wherein the carbon contact holder assembly includes another receptacle for another carbon contact, the two receptacles being connected by the supporting arm in a one piece manner and so as to form a supporting surface.

3. The laundry dryer as recited in claim 2 wherein the latching receptacle is integrally formed on the supporting surface.

4. The laundry dryer as recited in claim 3 wherein the plug in contact includes a connection element configured to connect to the flexible lead, the connection element being disposed underneath the supporting surface.

5. The laundry dryer as recited in claim 3 wherein a plugging axis of the latching receptacle is disposed at the angle α with respect to the longitudinal axis of the receptacle.

6. The laundry dryer as recited in claim 4 wherein a plugging axis of the at least one plug in contact is disposed at the angle α with respect to the longitudinal axis of the receptacle.

7. The laundry dryer as recited in claim 1 wherein the attachment section includes an attachment bracket integrally formed on the supporting arm, the attachment bracket including a supporting leg resting on a supporting structure of the housing and including a laterally positioned support bracket.

8. The laundry dryer as recited in claim 2 wherein the attachment section includes an attachment bracket integrally formed on the supporting arm, the attachment bracket including a supporting leg resting on a supporting structure of the housing and including a laterally positioned support bracket.

9. The laundry dryer as recited in claim 3 wherein the attachment section includes an attachment bracket integrally formed on the supporting arm, the attachment bracket including a supporting leg resting on a supporting structure of the housing and including a laterally positioned support bracket.

10. The laundry dryer as recited in claim 4 wherein the attachment section includes an attachment bracket integrally formed on the supporting arm, the attachment bracket including a supporting leg resting on a supporting structure of the housing and including a laterally positioned support bracket.

11. The laundry dryer as recited in claim 5 wherein the attachment section includes an attachment bracket integrally formed on the supporting arm, the attachment bracket including a supporting leg resting on a supporting structure of the housing and including a laterally positioned support bracket.

12. The laundry dryer as recited in claim 6 wherein the attachment section includes an attachment bracket integrally formed on the supporting arm, the attachment bracket including a supporting leg resting on a supporting structure of the housing and including a laterally positioned support bracket.

13. The laundry dryer as recited in claim 7 wherein the clamping strap is integrally formed on the support bracket.

14. The laundry dryer as recited in claim 7 wherein the supporting leg includes an integrally formed pin configured to position the carbon contact holder assembly on the housing with respect to the laundry drum.

15. The laundry dryer as recited in claim 7 wherein the laterally position support bracket includes integrally formed tabs configured to engage behind the supporting structure of the housing and position the carbon contact holder assembly on the housing with respect to the laundry drum.

16. The laundry dryer as recited in claim 13 wherein the laterally position support bracket includes integrally formed tabs configured to engage behind the supporting structure of the housing and position the carbon contact holder assembly on the housing with respect to the laundry drum.

17. The laundry dryer as recited in claim 14 wherein the laterally position support bracket includes integrally formed tabs configured to engage behind the supporting structure of the housing and position the carbon contact holder assembly on the housing with respect to the laundry drum.

* * * * *